US006213634B1

(12) United States Patent
Harrington et al.

(10) Patent No.: US 6,213,634 B1
(45) Date of Patent: Apr. 10, 2001

(54) COMBINED WATCH AND WRISTBAND

(76) Inventors: Ronald L. Harrington; Richard L. Rowsell, both of 488 Rte. 71, Hillsdale, NY (US) 12529

( * ) Notice: Subject to any disclaimer, the term of this patent is extended or adjusted under 35 U.S.C. 154(b) by 0 days.

(21) Appl. No.: 09/480,130

(22) Filed: Jan. 10, 2000

(51) Int. Cl.[7] ..... G04B 37/00; A44C 5/00

(52) U.S. Cl. ..... 368/283; 368/286; 224/170

(58) Field of Search ..... 368/88, 276, 286, 368/281, 282, 283, 287; 224/164, 168, 170, 173, 178

(56) References Cited

U.S. PATENT DOCUMENTS

D. 351,119 10/1994 McMullin .
D. 398,247 9/1998 Dumas .
1,479,363 * 1/1924 Brown ..... 348/289
2,076,221 * 4/1937 Bradbury ..... 368/286
4,645,102 2/1987 Proellochs .
4,769,799 9/1988 Matsukage .
4,862,521 9/1989 Mann .
4,958,279 9/1990 Proellochs .
5,762,241 6/1998 Cross .

* cited by examiner

*Primary Examiner*—Vit Miska
(74) *Attorney, Agent, or Firm*—Norman E. Lehrer

(57) ABSTRACT

A combination of a wristband and watch which includes a tubular wristband having an inner layer of material, an outer layer of material, and a watch placed therebetween is disclosed. The inner layer has a slit formed therein and the outer layer has an opening formed therein. The slit and opening are substantially aligned. The watch has a base and a face attached to the base. The opening includes button-hole stitching. The face includes a rim and a recess is formed between the base and the rim. Once the watch is in place, the stitching fits snugly within the recess, thereby securing the watch within the opening.

5 Claims, 2 Drawing Sheets

COMBINED WATCH AND WRISTBAND

BACKGROUND OF THE INVENTION

The present invention is directed toward a combination wristband and watch and more particularly, toward a watch which can be easily inserted and removed from the wristband.

Wristbands in the nature of sweatbands are often worn by athletes in order to absorb perspiration while they are participating in a sport. The wristband is made from a flexible, absorbent fabric or material, for example, cotton. Athletes often also wear watches while they are playing. A problem occurs, however, when the athlete wears two wristbands and also needs to wear a watch on his or her wrist. This problem has been addressed in prior patents. However, these patents fall short of solving the problem in that the function of the wristband has been compromised.

For example, U.S. Pat. No. 4,769,799 to Matsukage discloses the face of a watch mounted within a wristband worn by a person. The wristband is made from an elastic textile material which may absorb perspiration. The problem with this device, however, is that the wristband is not completely effective in absorbing perspiration because the back of the face is exposed to the wearer's wrist. Therefore, any perspiration present on that portion of the wearer's wrist will not be absorbed by the wristband.

Similarly, U.S. Pat. No. 4,645,102 to Proellochs discloses an assembly which includes a wristband and a watch enclosed therein. Again, the wristband may be made from a cotton fabric so that perspiration will be absorbed by the wristband. However, the back of the watch rests on the wearer's wrist, thereby creating the same problem discussed above with regard to the patent to Matsukage.

There remains a need for a combined wristband and watch which will not only effectively absorb perspiration but will also serve the function of a watch. Also, there exists a need for a combination wristband and watch which allows for the easy insertion and removal of the watch from the wristband so that the wristband can be laundered.

SUMMARY OF THE INVENTION

The present invention is designed to overcome the deficiencies of the prior art discussed above. It is an object of the present invention to provide a wristband combined with a watch.

It is another object of the present invention to provide a wristband and watch combination where the watch may be easily inserted and removed from the wristband.

It is a further object of the present invention to provide a wristband and watch combination where the wristband effectively absorbs the wearer's perspiration without compromising the function of the watch.

In accordance with the illustrative embodiment demonstrating features and advantages of the present invention, there is provided a wristband and watch combination which includes a tubular wristband having an inner layer of material, an outer layer of material, and a watch placed therebetween. The inner layer has a slit formed therein and the outer layer has an opening formed therein. The slit and opening are substantially aligned. The watch has a base and a face attached to the base. The opening and slit include button-hole stitching. The face includes a rim and a recess is formed between the base and the rim. Once the watch is in place, the stitching surrounding the opening fits snugly within the recess, thereby securing the watch within the opening.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
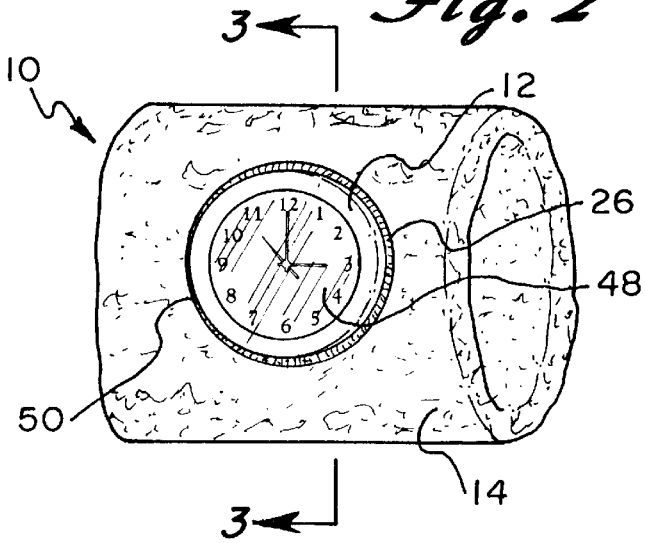
FIG. 2 is a front perspective view of the wristband and watch combination of the present invention.

Referring now to the drawings in detail wherein like reference numerals have been used throughout the various figures to designate like elements, there is shown in FIG. 2 a wristband and watch combination constructed in accordance with the principles of the present invention and designated generally as 10.

Figure 3:
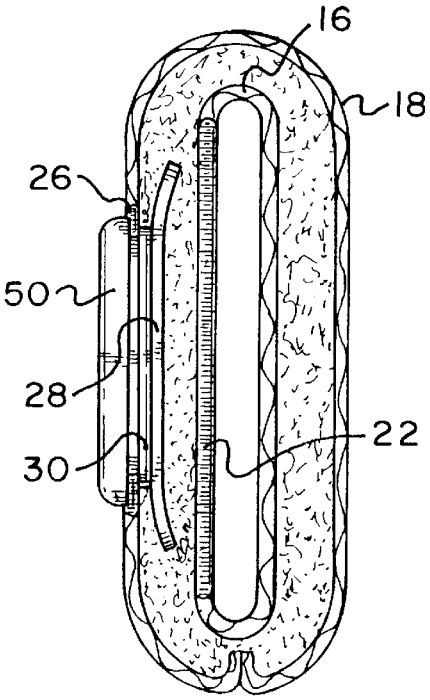
FIG. 3 is a cross-sectional view taken through line 3—3 of FIG. 2.
Figure 4:
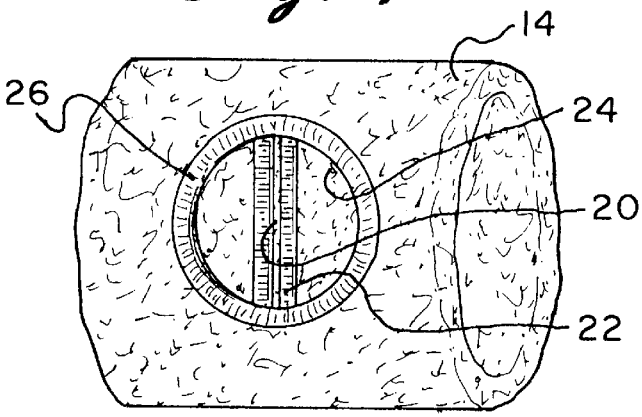
FIG. 4 is a front perspective view of the wristband prior to the watch being inserted therein.

The combination 10 essentially includes a watch 12 and a tubular wristband 14 formed by an inner layer 16 of material and an outer layer 18 of material sewn or otherwise joined together, thereby forming a two-ply wristband 14 throughout the entire circumference thereof. As best seen in FIGS. 2–4, the inner and outer layers have inner surfaces that face each other and outer surfaces that face away from each other. The wristband 14 may be made from a flexible material or fabric, for example, cotton. The material may also be knit. The two layers 16 and 18 may be made from the same material or from two different types of material. Preferably the outer surface of the inner layer 16 which contacts the wearer's skin when worn is made of a material which can absorb sweat. The inner layer 16 has a slit 20 formed therein. The edge of the slit 20 is reinforced with button-hole or satin stitching or embroidery 22. The stitching 22 prevents the unraveling of the material and is a technique well known and used in the art. The outer layer 18 has a circular opening 24. The edge of the opening 24 also includes button-hole or similar stitching or embroidery 26. The purpose of the stitching 26 is the same as the purpose of the stitching 22 around the slit 20. However, the stitching 26 has a further function which will be discussed in greater detail below. The slit 20 and the opening 24 should be substantially aligned. (See FIG. 4.)

Figure 1:
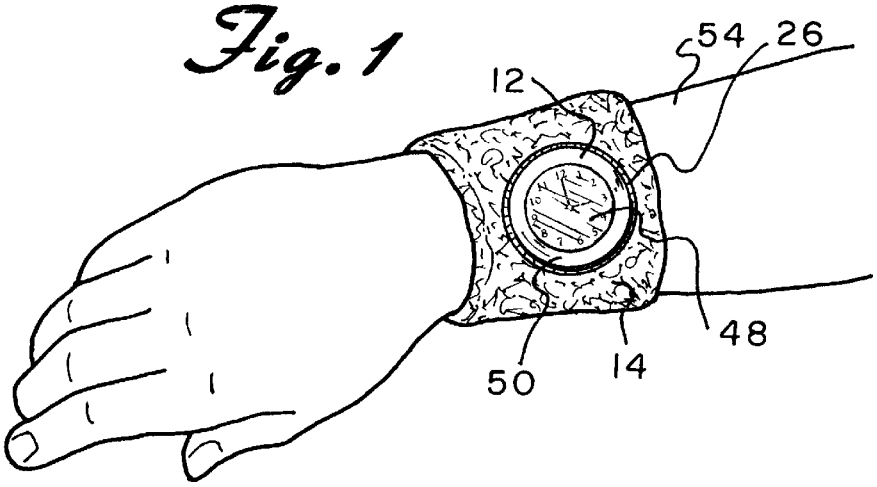
FIG. 1 is a representation of the wristband and watch combination of the present invention being worn on a person's wrist.
Figure 5:
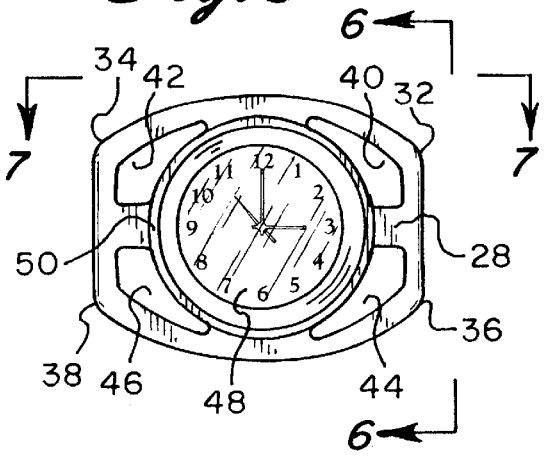
FIG. 5 is a front elevational view of the watch of the present invention.
Figure 6:
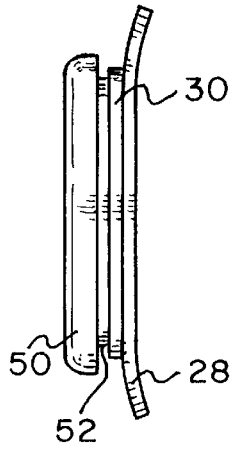
FIG. 6 is a right side elevational view taken along line 6—6 of FIG. 5.
Figure 8:
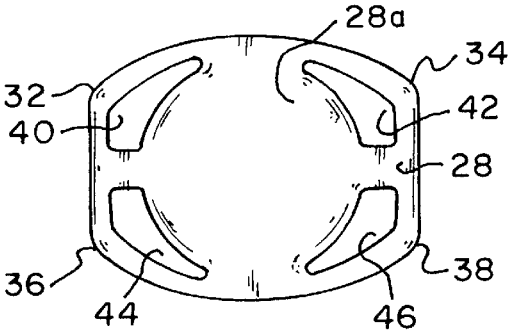
FIG. 8 is a rear elevational view of the watch of the present invention.
Figure 7:
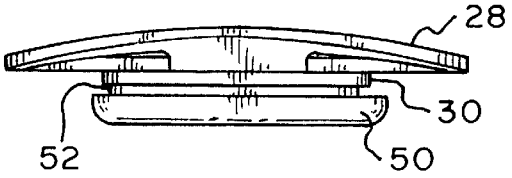
FIG. 7 is a top plan view taken along line 7—7 of FIG. 5.

The watch 12 includes a generally rectangular base 28 which may be slightly curved so that the watch 12 rests comfortably on the wearer's wrist. (See FIG. 1.) As best shown in FIGS. 5 and 8, the base 28 has a width dimension (left to right in FIGS. 5 and 8) which is greater than the height dimension (top to bottom as seen in FIGS. 5 and 8). Alternatively, the base 28 need not be curved. The base 28 also has a member 30 which extends outwardly from the center of the base 28. Each corner 32, 34, 36, and 38 of the base 28 may also have an opening 40, 42, 44, and 46, respectively, formed therein. (See FIG. 8.) A face 48 is secured to the member 30 of the base 28 and includes a rim 50. The shape of the face 48 and rim 50 may be almost any shape, for example, circular, oval, square, or rectangular. However, the base 28 is preferably larger than the face 48 of the watch 12. An annular recess 52 is formed between the member 30 and the rim 50, thereby forming a bezel. The base 28, rim 50, and member 30 may be formed from plastic or the like.

Figure 9:
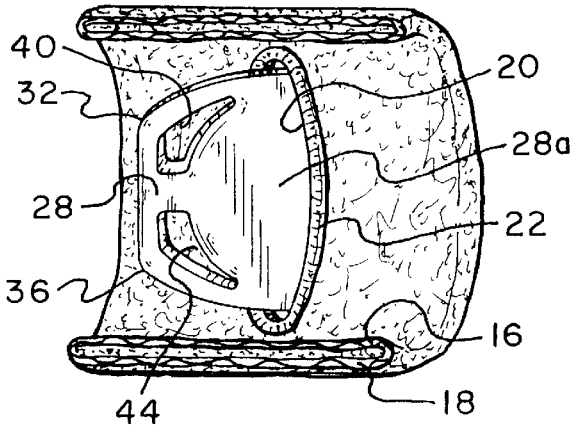
FIG. 9 illustrates the watch being inserted through the slit of the wristband.
Figure 10:
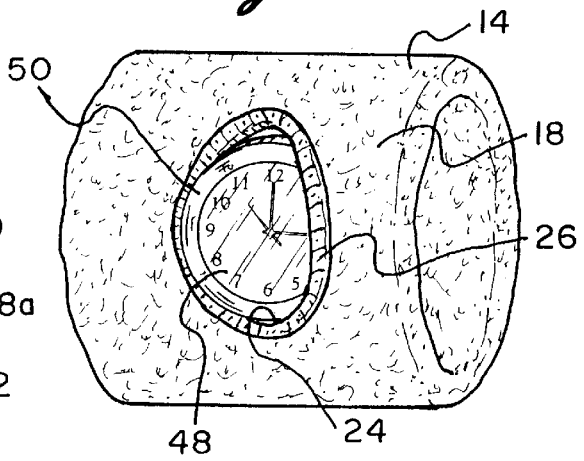
FIG. 10 illustrates the watch fitting within the opening of the wristband.

In order to place the watch 12 within the wristband 14, the watch 12 is inserted through the slit 20 of the inner layer 16, with the face 48 facing outwardly and the width dimension of the base 28 arranged so as to be in the axial direction of the wristband 14. (See FIG. 9.) The face 48 is then positioned within the opening 24 of the outer layer 18 so that the stitching 24 fits snugly within the recess 52, thereby securing the base 28 in place between the inner and outer layers 16 and 18, respectively. (See FIG. 10.)The base 28 now rests between the inner layer 16 and outer layer 18 so that the watch 12 remains in the proper position and does not inadvertently pop or slip out of the opening 24. Furthermore, because the base 28 is larger than the face 48 of the watch 12, it cannot pass through the opening 24. Because only a slit 20 is formed in the inner layer 16, the back or rear surface 28*a* of the base 28 is not exposed. As a result, the base 28 does not rest on the wearer's wrist 54, rather the wristband 14 rests on the wearer's wrist 54. Thus, any perspiration at that area is absorbed by the wristband.

In order to remove the watch 12 so that the wristband 14 may be laundered or, if the wearer would like to insert a different watch within the wristband, the wristband 14 is manipulated so that the base 28 is eased out of the slit 20. As a result, the face 48 of the watch 12 slips out of the opening 24 and the entire watch 12 may be removed from the slit 20. In this manner, the watch 12 is easily inserted and removed from the wristband 14.

The present invention may be embodied in other specific forms without departing from the spirit or essential attributes thereof and accordingly, reference should be made to the appended claims rather than to the foregoing specification as indicating the scope of the invention.

We claim:

1. A combination wristband and watch comprising:

a tubular wristband having a circumference and adapted to encircle a person's wrist, said wristband having an inner layer of material with a slit formed therein and an outer layer of material with an opening formed therein, said slit and said opening being substantially aligned;

each of said inner and outer layers of material extending throughout substantially the entire circumference of said wristband whereby said wristband is formed of two plies throughout substantially the entire circumference thereof;

each of said inner and outer layers of material also having inner surfaces that face each other and outer surfaces facing away from each other, the outer surface of said inner layer of material contacting a person's skin when the combination wristband and watch is worn and being adapted to absorb sweat, and a watch having a base and a face attached to said base, said base having a width dimension and a height dimension wherein said width dimension is greater than said height dimension, said watch being secured between said inner and outer layers of said wristband with said face being exposed through said opening and with said width dimension of said base being arranged so as to be in the axial direction of said tubular wristband.

2. The combination of claim 1 wherein said opening has means for securing said base between said inner and outer layers.

3. The combination of claim 2 wherein said means for securing includes button-hole stitching.

4. The combination of claim 2 wherein said face includes a rim, a recess being formed between said base and said rim and said securing means of said opening fitting snugly within said recess.

5. The combination of claim 1 wherein said slit includes stitching.

* * * * *